US008648281B2

(12) United States Patent
Utsumi et al.

(10) Patent No.: US 8,648,281 B2
(45) Date of Patent: Feb. 11, 2014

(54) STEAM GENERATING DEVICE AND COOKING DEVICE

(75) Inventors: Takashi Utsumi, Osaka (JP); Hideo Shimoda, Osaka (JP); Shinya Ueda, Osaka (JP); Yasuhiro Sakoda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 367 days.

(21) Appl. No.: 12/994,634

(22) PCT Filed: Jun. 24, 2009

(86) PCT No.: PCT/JP2009/061510
§ 371 (c)(1),
(2), (4) Date: Nov. 24, 2010

(87) PCT Pub. No.: WO2009/157480
PCT Pub. Date: Dec. 30, 2009

(65) Prior Publication Data

US 2011/0095013 A1 Apr. 28, 2011

(30) Foreign Application Priority Data

Jun. 26, 2008 (JP) ..... 2008-166697

(51) Int. Cl.
*A21B 1/24* (2006.01)
*A21B 3/04* (2006.01)
*A47J 27/16* (2006.01)

(52) U.S. Cl.
USPC ..... 219/401; 126/20; 392/402

(58) Field of Classification Search
None
See application file for complete search history.

(56) References Cited

U.S. PATENT DOCUMENTS

| | | | | |
|---|---|---|---|---|
| 4,377,737 | A * | 3/1983 | Berry | 392/401 |
| 5,063,609 | A * | 11/1991 | Lorimer | 392/401 |
| 6,040,564 | A | 3/2000 | Ueda et al. | |
| 6,133,558 | A | 10/2000 | Ueda et al. | |
| 6,906,291 | B2 * | 6/2005 | Shozo | 219/401 |
| 7,326,893 | B2 * | 2/2008 | Kanzaki et al. | 219/682 |
| 7,759,615 | B2 * | 7/2010 | Ando et al. | 219/401 |
| 7,847,220 | B2 * | 12/2010 | Jeon et al. | 219/401 |
| 8,044,326 | B2 * | 10/2011 | Ando et al. | 219/401 |
| 8,256,409 | B2 * | 9/2012 | Matsubayashi et al. | 126/21 A |
| 2003/0101875 | A1 | 6/2003 | Ono | |
| 2003/0159593 | A1 | 8/2003 | Leutwyler | |
| 2005/0051530 | A1 * | 3/2005 | Shozo | 219/401 |
| 2006/0225726 | A1 * | 10/2006 | Andoh et al. | 126/20 |
| 2007/0187388 | A1 * | 8/2007 | Yamaguchi et al. | 219/401 |

(Continued)

FOREIGN PATENT DOCUMENTS

| | | | |
|---|---|---|---|
| CN | 1188534 | A | 7/1998 |
| CN | 1526992 | A | 9/2004 |

(Continued)

*Primary Examiner* — Joseph M Pelham
(74) *Attorney, Agent, or Firm* — Birch, Stewart, Kolasch & Birch, LLP

(57) ABSTRACT

A steam generating device (1) is provided with a metal housing (2), a water supply opening (3) for supplying water into the housing (2), a steam generating heater (4) embedded in the lower part of the housing (2) and evaporating the water supplied from the water supply opening (3), a steam temperature raising heater (5) provided above the steam generating heater (4) with a predetermined distance from an inner wall of the housing (2) and raising the temperature of the steam generated by the steam generating heater (4), and a discharge opening (8) for discharging the superheated steam generated by the steam temperature raising heater (5).

20 Claims, 5 Drawing Sheets

(56) References Cited

U.S. PATENT DOCUMENTS

| | | | | |
|---|---|---|---|---|
| 2007/0187389 | A1* | 8/2007 | Chiang | 219/401 |
| 2007/0210058 | A1* | 9/2007 | Ando et al. | 219/401 |
| 2007/0210059 | A1* | 9/2007 | Ando et al. | 219/401 |
| 2009/0007798 | A1* | 1/2009 | Yamaguchi et al. | 99/330 |
| 2009/0272729 | A1* | 11/2009 | Ando et al. | 219/401 |

FOREIGN PATENT DOCUMENTS

| | | | |
|---|---|---|---|
| CN | 1792301 | A | 6/2006 |
| JP | 2004-347149 | A | 12/2004 |
| JP | 2006-349313 | A | 12/2006 |
| RU | 2254036 | C2 | 6/2005 |
| RU | 2265388 | C2 | 12/2005 |

* cited by examiner

STEAM GENERATING DEVICE AND COOKING DEVICE

BACKGROUND OF THE INVENTION

1. Field of the Invention

The present invention relates to a steam generating device and a cooking device using the same.

2. Description of the Related Art

A cooking device that uses a conventional steam generating device is disclosed in in patent document 1. In this cooking device, the steam generating device is mounted on an outer wall of a heat room that houses a food material to be cooked. The steam generating device has a housing that is formed of a die casting of a metal such as aluminum and the like. A cavity is formed in the housing and heaters are molded and embedded in upper and lower wall surfaces. Many fins are formed on an inner wall of the housing.

A water supply opening is formed through a central portion in a vertical direction of a side surface of the housing. The water supply opening is connected to a water supply tank, and water is supplied into the housing via the water supply opening. A steam outlet facing the heat room is formed through an upper portion of the housing.

When water is supplied into the steam generating device from the water supply opening, the water is stored in a bottom portion of the housing and steam is generated by driving the heater. The steam generated rises in the housing and touches the high-temperature wall surface and fins of the housing to be further heated. As a result of this, superheated steam is generated and made to flow into the heat room via the outlet. And, the food material is cooked by the superheated steam supplied into the heat room.

PRIOR-ART DOCUMENT

Patent Document

Patent document 1: JP-A-2006-349313 (pp. 3 to 11, FIG. 5)

SUMMARY OF THE INVENTION

Problems to be Solved by the Invention

However, according to the above conventional steam generating device, aluminum and an aluminum alloy that are easily cast and have high heat conductivity are used for the housing of the steam generating device. Accordingly, the housing has a low melting point (660° C. in a case of aluminum) and softens at about 400° C. As a result of this, it is necessary to keep the heater embedded in the housing at a temperature lower than 400° C., and the temperature of the superheated steam flowing out from the outlet becomes 200° C. or lower. Accordingly, there is a problem that the temperature of the superheated steam is low and it is impossible to perform good cooking.

It is an object of the present invention to provide a steam generating device that is able to supply higher-temperature superheated steam; and a cooking device that is able to perform good cooking by using the steam generating device.

Means for Solving the Problem

To achieve the above object, a steam generating device according to the present invention includes: a metal housing; a water supply opening that supplies water into the housing; a steam generating heater that is embedded in a lower portion of the housing and vaporizes the water supplied from the water supply opening; a steam temperature raising heater that is disposed above the steam generating heater, away from an inner wall of the housing by a predetermined distance and raises temperature of the steam generated by the steam generating heater; and an outlet from which superheated steam generated by the steam temperature raising heater flows out.

According to this structure, when water is supplied into the housing from the water supply opening, the water is stored in a bottom portion of the housing and steam is generated by the driving of the steam generating heater. The steam generated rises in the housing and is further raised in temperature by the steam temperature raising heater that is disposed away from the inner wall of the hosing by the predetermined distance. As a result of this, superheated steam is generated and the superheated steam is flowed out from the outlet.

Besides, in the steam generating device having the above structure according to the present invention, the steam generating heater generates heat at a temperature lower than a softening temperature of the housing; and the steam temperature raising heater generates heat at a temperature higher than the softening temperature of the housing. According to this structure, for example, in a case where the housing is formed of an aluminum die casting, the steam generating heater generates heat at a temperature lower than 400° C. and the steam temperature raising heater generates heat at a temperature higher than 400° C.

Besides, the steam generating device having the above structure according to the present invention includes a partition member that forms a steam path which guides the steam generated by the steam generating heater through the steam temperature raising heater to the outlet. According to this structure, the steam generated in the lower portion of the housing by the steam generating heater flows through the steam path formed by the partition member, is further raised in temperature by the steam temperature raising heater and is guided to the outlet.

Besides, in the steam generating device having the above structure according to the present invention, the partition member encloses the steam temperature raising heater; is disposed away from the inner wall of the housing; and the steam path is formed between the housing and the partition member. According to this structure, the steam generated in the lower portion of the housing by the steam generating heater flows between the partition member and the inner wall and flows into a space enclosed by the partition member. The steam flowing into the space enclosed by the partition member is further raised in temperature by the steam temperature raising heater, then, is guided to the outlet.

Besides, in the steam generating device having the above structure according to the present invention, the steam path in the space enclosed by the partition member is formed to be serpentine.

Besides, in the steam generating device having the above structure according to the present invention, heat resistance of the partition member is higher than the housing.

Besides, in the steam generating device having the above structure according to the present invention, the housing is formed of aluminum or an aluminum alloy; and the partition member is formed of stainless steel.

Besides, in the steam generating device having the above structure according to the present invention, a surface of the partition member which faces the steam temperature raising heater is formed to have a dark color. According to this structure, the partition member absorbs radiant heat from the steam temperature raising heater and temperature rise of the housing is curbed. Besides, electrolytic corrosion of a junction portion of different metals between the partition member and the housing is prevented.

Besides, in the steam generating device having the above structure according to the present invention, the partition member is provided with a fin for heat exchange. According to this structure, the steam flowing along the partition member performs heat exchange with heat that is conducted from the steam temperature raising heater to the fin.

Besides, in the steam generating device having the above structure according to the present invention, a surface of the housing through which the outlet is formed protrudes beyond the lower portion where the steam generating heater is embedded. According to this structure, when the housing is mounted with the forming surface of the outlet faced with the heat room and the like into which the steam is supplied, the lower portion of the housing where the steam generating heater is embedded is disposed away from the mounting surface.

Besides, a cooking device according to the present invention includes: the steam generating device having each of the above structures; a heat room that houses a food material to be cooked and is supplied with superheated steam from the outlet; a circulation fan that circulates the steam in the heat room; and a circulation heater that heats the steam circulated by the circulation fan. According to this structure, the superheated steam is supplied from the steam generating device into the heat room; and the superheated steam is circulated by the circulation fan, so that cooking is performed. The steam circulated by the circulation fan is heated by the circulation heater, so that the steam is kept at a predetermined temperature.

Advantages of the Invention

According to a steam generating device of the present invention, a steam generating heater is embedded in a lower portion of a housing and a steam temperature raising heater is disposed away from an inner wall of the housing by a predetermined distance, so that it is possible to curb temperature rise of the housing even if the temperature of the steam temperature raising heater is raised. Accordingly, it is possible to flow out superheated steam having a temperature higher than the conventional.

Besides, according to a cooking device of the present invention, because superheated steam having a temperature higher than the conventional is supplied into a heat room, it is possible to perform good cooking.

DETAILED DESCRIPTION OF THE INVENTION

Figure 1:
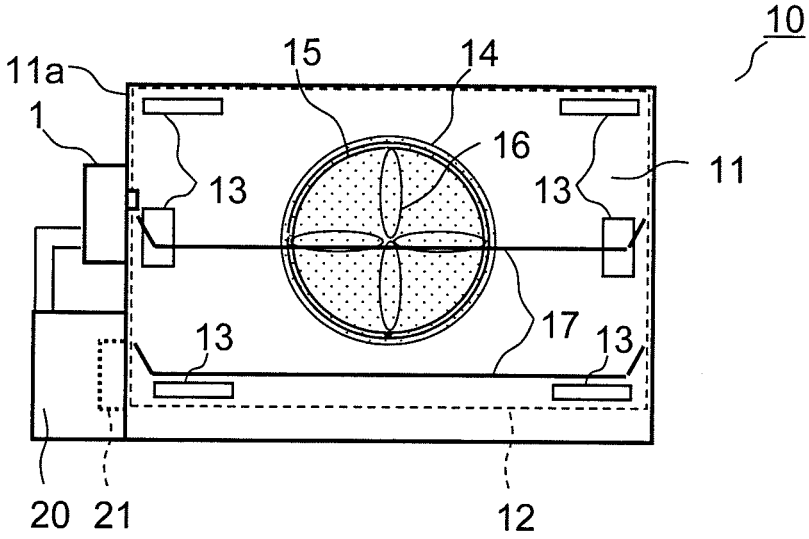
FIG. 1 is a front view showing a cooking device according to a first embodiment of the present invention.
Figure 2:
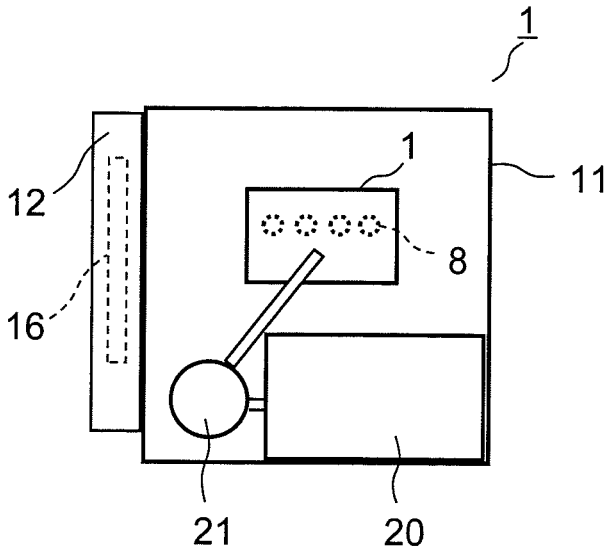
FIG. 2 is a left side view showing the cooking device according to the first embodiment of the present invention.
Figure 3:
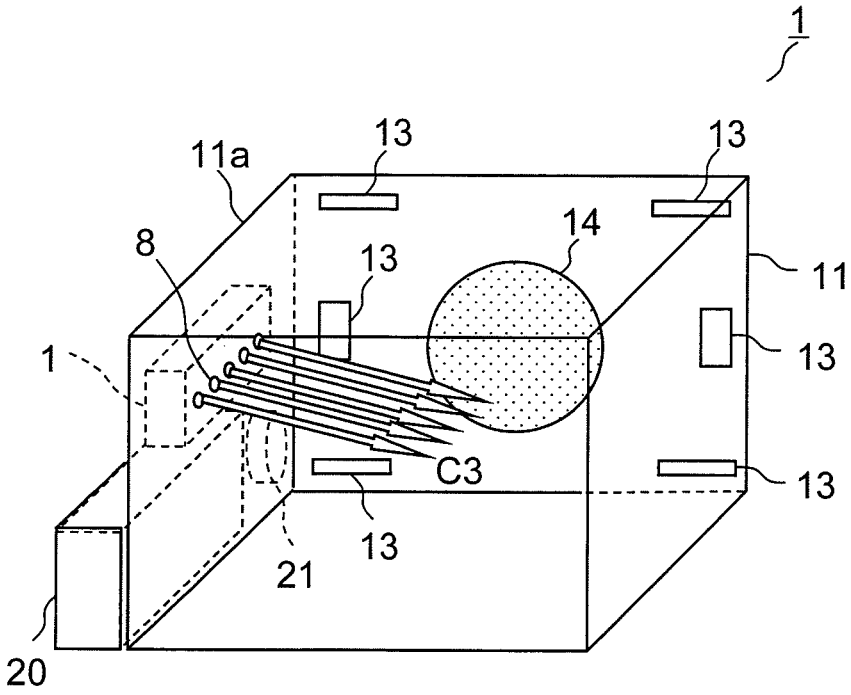
FIG. 3 is a perspective view showing the cooking device according to the first embodiment of the present invention.

Hereinafter, the embodiments of the present invention are described with reference to the drawings. FIG. 1, FIG. 2, and FIG. 3 are a front view, a left side view and a perspective view of a cooking device according to a first embodiment, respectively. A cooking device 10 has substantially a rectangular-parallelepiped heat room 11 that houses a food material to be cooked. In the heat room 11, trays 17 on which food materials are placed are disposed in two stages of top and bottom.

On one side wall 11*a* of the heat room 11, a steam generating device 1, which supplies steam to the heat room 11 via an outlet 8, is mounted. Below the steam generating device 1, a removable water supply tank 20 is disposed. Behind the water supply tank 20, a water supply pump 21, which is connected to a water supply opening 3 (see FIG. 4) of the steam generating device 1, is disposed. When the water supply tank 20 is mounted, the water supply tank 20 is connected to the water supply pump 21 via a joint (not shown). By the driving of the water supply pump 21, water is supplied to the steam generating device 1 from the water supply tank 20.

Behind the heat room 11, a circulation duct 12 is disposed. The circulation duct 12 has an air inlet 14 at a central portion of a rear wall of the heat room 11 and a plurality of spew outlets 13 along a circumferential portion of the rear wall of the heat room 11. In the circulation duct 12, a circulation heater 15 including a ring-shape sheathed heater and a circulation fan 16 are disposed.

Figure 4:
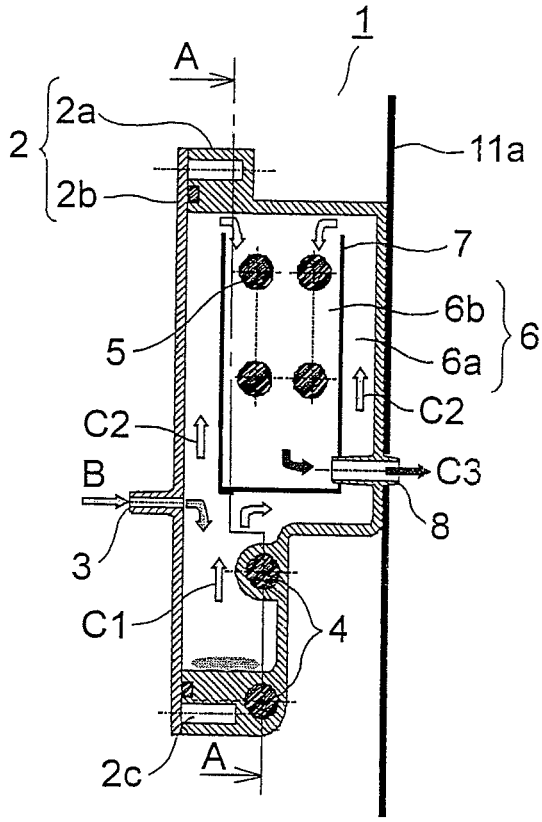
FIG. 4 is a front sectional view showing a steam generating device of the cooking device according to the first embodiment of the present invention.
Figure 5:
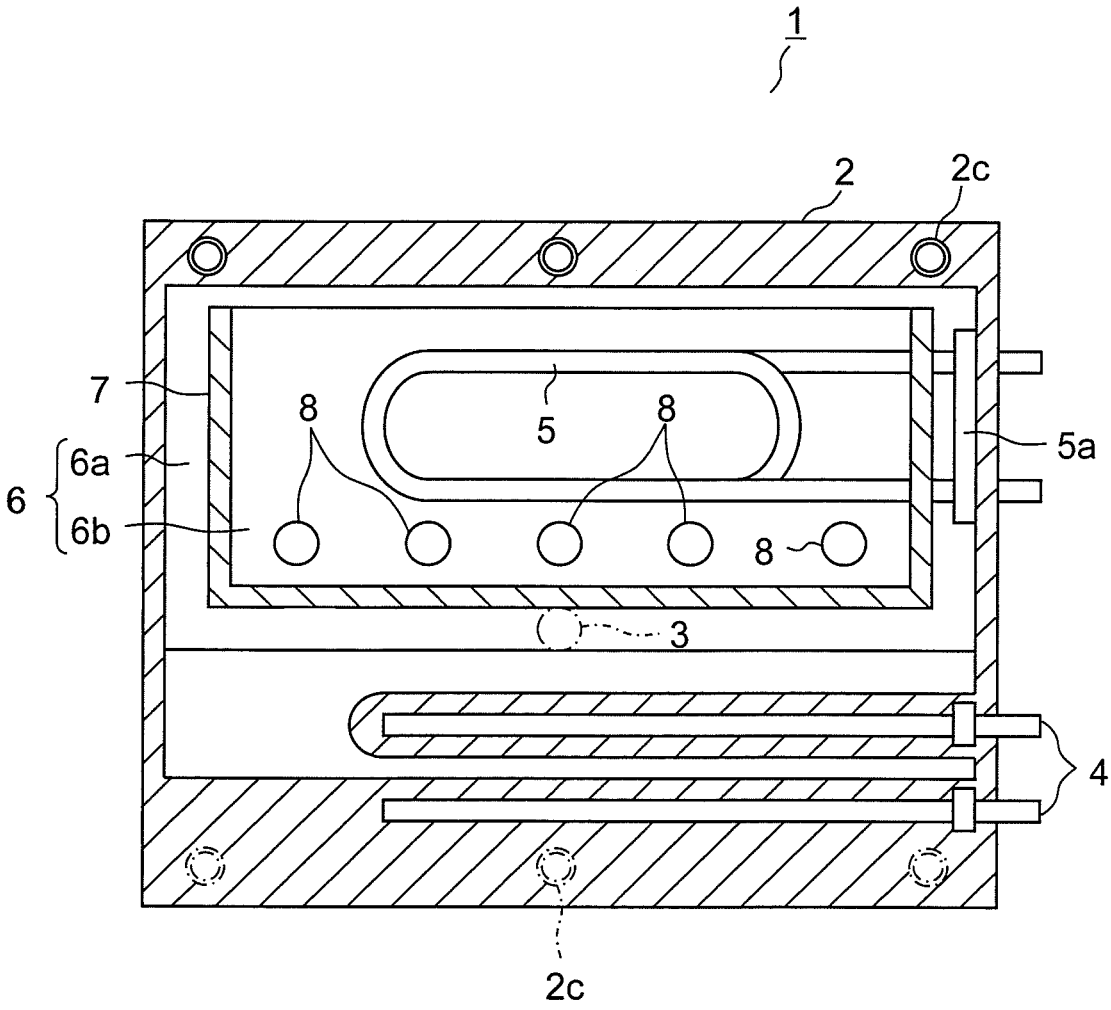
FIG. 5 is an A-A sectional view in FIG. 4.

FIG. 4 shows a front sectional view of the steam generating device 1. Besides, FIG. 5 shows an A-A sectional view in FIG. 4. The steam generating device 1 has a housing 2 that is formed of a metal die casting. As for the housing 2, an open surface of a box-shape main-body portion 2*a* is closed by a cover portion 2*b* that is fixed with a screw 2*c*; and a cavity is formed inside. As a material of the housing 2, it is desirable to use aluminum or an aluminum alloy because they are easily cast and have high heat conductivity.

Through the cover portion 2*b* of the housing 2, the water supply opening 3 connected to the water supply pump 21 (see FIG. 1) is opened at a central portion in a vertical direction. The main-body portion 2*a* is provided with a plurality of outlets 8 that face the side wall 11*a* of the heat room 11.

In a lower portion of the housing 2, a steam generating heater 4 that includes a sheathed heater is disposed. The steam generating heater 4 is molded and embedded in the housing 2 and in tight contact with the housing 2, so that heat from the steam generating heater 4 is efficiently conducted to the housing 2. As a result of this, water dropped from the water supply opening 3 and stored in a bottom portion of the housing 2 is vaporized by the heat that is conducted from the steam generating heater 4 to the housing 2, so that steam is generated.

A forming surface of the outlet 8 is so disposed as to protrude beyond the lower portion of the housing 2 where the steam generating heater 4 is embedded. Accordingly, the lower portion of the housing 2 that is heated to a high temperature by the steam generating heater 4 is disposed away from the wall surface 11*a* of the heat room 11. As a result of this, it is possible to simplify a heat-resistant structure of the heat room 11.

In an upper portion of the housing 2, steam temperature raising heaters 5 that include a sheathed heater formed into a spiral shape are disposed in such a way that they are arranged into a plurality of lines in a left-to-right direction. The steam temperature raising heater 5 is mounted in the housing 2 by means of a flange portion 5*a* that is a non-heat generating portion; and a heat generating portion is disposed away from an inner wall of the housing 2 by a predetermined distance.

Around the steam temperature raising heater 5, a box-shape partition member 7 which has an opened upper surface and encloses the steam temperature raising heater 5 is disposed. The outlet 8 is formed into a cylindrical shape that penetrates the partition member 7 and the outlet 8 is disposed in a lower portion of the bottomed partition member 7. Besides, the partition member 7 is supported with a portion thereof joined to the housing 2; and disposed away from the inner wall of the housing 2 by a predetermined distance. As a result of this, a steam path 6, which guides steam from the lower portion of the housing 2 to the outlet 8 through the steam temperature raising heater 5, is formed.

The steam path 6 includes: an outer path 6*a* outside the partition member 7; and an inner path 6*b* inside the partition member 7. The outer path 6*a* and the inner path 6*b* communicate with each other at an upper end of the partition member 7; and the outlet 8 is disposed in the lower portion of the space enclosed by the partition member 7. As a result of this, the path length of the steam path 6 is longer than the height of the housing 2 even at the shortest.

The partition member 7 is formed of a metal or a ceramic having heat resistance higher than the housing 2; and it is more desirable to use stainless steel and the like that are excellent in corrosion resistance and heat conductivity. Heat-resistant black coating is applied to a surface of the partition member 7 which faces the steam temperature raising heater 5, so that the surface is formed to have a dark color. As a result of this, the partition member 7 absorbs radiant heat from the steam temperature raising heater 5 and temperature rise of the housing 2 is curbed. Besides, electrolytic corrosion of a junction portion of different metals between the partition member 7 and the housing 2 is prevented.

In the cooking device 10 having the above structure, the water supply tank 20 in which water is stored is mounted, a food material is placed on the tray 7 and cooking is started. When the cooking is started, the water supply pump 21 is driven, then, the steam generating heater 4 and the steam temperature raising heater 5 are driven. Water is supplied into the housing 2 of the steam generating device 1 from the water supply opening 3 by the water supply pump 21 as shown by an arrow B.

The water supplied into the housing 2 is stored in the lower portion of the housing 2 and vaporized by the steam generating heater 4, so that steam is generated. At this time, the steam generating heater 4 generates heat at a temperature lower than a softening temperature of the housing 2. Besides, the steam temperature raising heater 5 is away from the housing 2 and insulated from the housing 2 by the partition member 7, so that the steam temperature raising heater 5 generates heat at a temperature higher than the softening temperature of the housing 2.

For example, in a case where the housing 2 is formed of aluminum or an aluminum alloy, the softening temperature is about 400° C. Accordingly, because the steam generating heater 4 needs only to vaporize the water, the steam generating heater 4 generates heat at about 200° C. Besides, to produce high-temperature superheated steam, the steam temperature raising heater 5 generates heat at about 600° C.

The steam generated in the lower portion of the housing 2 rises in the steam path 6 as shown by an arrow C1; and flows through the outer path 6*a* outside the partition member 7 as shown by an arrow C2. The steam flowing through the outer path 6*a* performs heat exchange with the partition member 7 that absorbs the radiant heat from the steam temperature raising heater 5. Besides, the steam flowing through the outer path 6*a* performs heat exchange with the housing 2, so that the housing 2 is cooled. Incidentally, a fin for heat exchange may be disposed on an outer surface of the partition member 7 or on an inner wall of the housing 2. As a result of this, it is possible to improve the heat exchange efficiency.

The steam flowing into the inside of the partition member 7 from the upper portion goes downward because of steam pressure and is guided to the outlet 8. At this time, the steam performs heat exchange with an inner surface of the partition member 7 and the steam temperature raising heater 5 to be raised in temperature. As a result of this, superheated steam is generated and supplied from the outlet 8 to the heat room 11 as shown by an arrow C3. The fin for heat exchange may be disposed on the inner surface of the partition member 7.

The food material on the tray 17 is cooked by the superheated steam supplied into the heat room 11. Besides, the steam in the heat room 11 flows into the circulation duct 12 via the air inlet 14 by the driving of the circulation fan 16. The steam flowing through the circulation duct 12 is heated by the circulation heater 15 and spewed out into the heat room 11 from the spew outlet 13. As a result of this, the steam in the heat room 11 is kept at a predetermined temperature.

According to the present embodiment, the steam generating heater 4 is embedded in the lower portion of the housing 2; and the steam temperature raising heater 5 is disposed away from the inner wall of the housing 2 by the predetermined distance, so that it is possible to curb temperature rise of the housing 2 even if the temperature of the steam temperature raising heater 5 is raised. Accordingly, it is possible to spew out steam that has a temperature (e.g., 300° C. or higher) higher than the conventional. As a result of this, it is possible to perform good cooking.

Besides, the steam generating heater 4 generates heat at a temperature lower than the softening temperature of the housing 2; and the steam temperature raising heater 5 generates heat at a temperature higher than the softening temperature of the housing 2, so that it is possible to prevent thermal deformation of the housing 2 and easily generate the high-temperature superheated steam.

Besides, the steam path 6, which guides the steam generated by the steam generating heater 4 to the outlet 8 through the steam temperature raising heater 5, is formed by the partition member 7. Accordingly, it is possible to prevent a shortcut through which the steam directly flows out from the outlet 8 without flowing through the steam temperature raising heater 5 from the lower portion of the housing 2; and surely generate the superheated steam.

Besides, the partition member 7 encloses the steam temperature raising heater 5 and the partition member 7 is disposed away from the inner wall of the housing 2, so that it is possible to prevent overheat of the housing 2. Besides, the steam flows through the steam path 6 (outer path 6*a*) between the housing 2 and the partition member 7 to cool the housing 2, so that it is possible to further prevent overheat of the housing 2.

Besides, the surface of the partition member 7 which faces the steam temperature raising heater 5 is formed to have a dark color, so that the partition member 7 is able to absorb the radiant heat from the steam temperature raising heater 5 to further prevent overheat of the housing 2. Besides, it is possible to prevent electrolytic corrosion of a junction portion of different metals between the partition member 7 and the housing 2.

Figure 6:
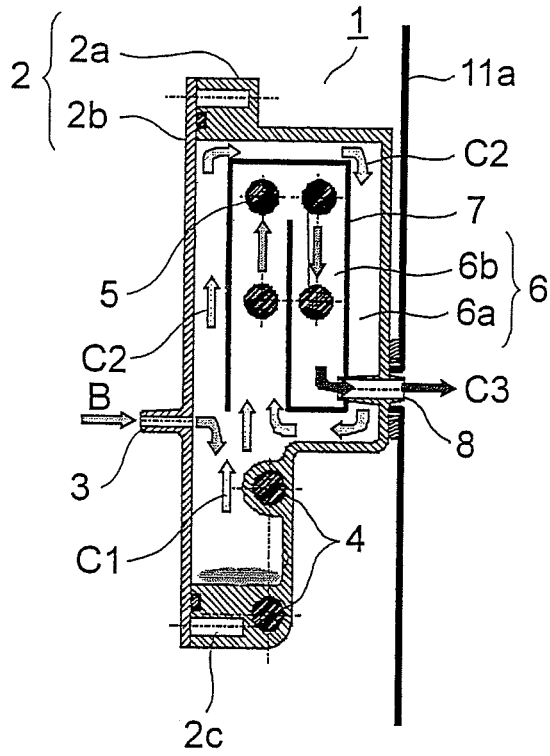
FIG. 6 is a front sectional view showing a steam generating device of a cooking device according to a second embodiment of the present invention.

Next, FIG. 6 is a front sectional view showing a steam generating device according to a second embodiment of the present invention. For convenience of description, the same portions as the first embodiment shown in the above FIG. 1 to FIG. 5 are indicated by the same reference numbers. The shape of the partition member 7 in the present embodiment is different from the first embodiment. The other portions are the same as the first embodiment.

The partition member 7 is formed into an eddy shape with a portion of the lower surface in front section opened; and the steam path 6 is formed to be serpentine into a U shape by the partition member 7. The steam generated in the lower portion of the housing 2 rises in the steam path 6: part of the steam flows into the inside of the partition member 7, while the remaining steam circulates in the outside of the partition member 7, then, flows into the inside of the partition member 7.

As a result of this, the average path length of the steam path 6 is lengthened two times or longer than the height of the housing 2, so that it is possible to increase the heat exchange area for the steam. Accordingly, it is possible to obtain the same effects as in the first embodiment and spew out higher-temperature superheated steam from the outlet 8.

In the present embodiment, the partition member 7 is formed into the eddy shape in the front section; however, the steam path 6 may be formed to be serpentine by disposing the outlet 8 on one of the front and the rear and by forming a portion of the upper surface into an eddy shape in top section. Besides, by alternately protruding the wall surface from the opposite partition member 7, the steam path 6 that is serpentine into an S shape may be formed, or the steam path 6 that is serpentine into a maze shape may be formed.

INDUSTRIAL APPLICABILITY

The present invention is applicable to a steam generating device that generates superheated steam and to a cooking device that uses the steam generating device.

LIST OF REFERENCE SYMBOLS

1 steam generating device
2 housing
3 water supply opening
4 steam generating heater
5 steam temperature raising heater
6 steam path
7 partition member
8 outlet
10 cooking device
11 heat room
12 circulation duct
13 spew outlet
14 air inlet
15 circulation heater
16 circulation fan
20 water supply tank
21 water supply pump

The invention claimed is:

1. A steam generating device comprising:
a metal housing;
a water supply opening that supplies water into the housing;
a steam generating heater that is embedded in a lower portion of the housing and vaporizes the water supplied from the water supply opening to generate steam;
a steam temperature raising heater that raises temperature of the steam generated by the steam generating heater;
an outlet from which superheated steam generated by the steam temperature raising heater flows out; and
a partition member disposed in the housing and having a portion extending in a vertical direction, wherein
the housing is provided with the outlet,
an upper portion of the housing is provided with the steam temperature raising heater, and
the steam generated by the steam generating heater is guided to the steam temperature raising heater by the partition member.

2. The steam generating device according to claim 1, wherein
the steam generating heater generates heat at a temperature lower than a softening temperature of the housing; and
the steam temperature raising heater generates heat at a temperature higher than the softening temperature of the housing.

3. The steam generating device according to claim 1, wherein
the steam temperature raising heater is disposed above the steam generating heater.

4. The steam generating device according to claim 1, wherein
the partition member encloses the steam temperature raising heater; is disposed away from the inner wall of the housing; and a steam path is formed between the housing and the partition member.

5. The steam generating device according to claim 1, wherein
a steam path in a space enclosed by the partition member is formed to be serpentine.

6. The steam generating device according to claim 1, wherein
heat resistance of the partition member is higher than the housing.

7. The steam generating device according to claim 6, wherein
the housing is formed of aluminum or an aluminum alloy; and
the partition member is formed of stainless steel.

8. The steam generating device according to claim 1, wherein
heat resistant black coating is applied to a surface of the partition member which faces the steam temperature raising heater.

9. The steam generating device according to claim 1, wherein
the partition member is provided with a fin for heat exchange.

10. The steam generating device according to claim 1, wherein
the outlet is formed through the housing, and
a surface through which the outlet is formed protrudes beyond the lower portion where the steam generating heater is embedded.

11. A cooking device comprising:
the steam generating device according to claim 1;
a heat room that houses a food material to be cooked and is supplied with superheated steam from the outlet;
a circulation fan that circulates steam in the heat room; and
a circulation heater that heats the steam circulated by the circulation fan.

12. A cooking device comprising:
the steam generating device according to claim 2;
a heat room that houses a food material to be cooked and is supplied with superheated steam from the outlet;
a circulation fan that circulates steam in the heat room; and
a circulation heater that heats the steam circulated by the circulation fan.

13. A cooking device comprising:
the steam generating device according to claim 3;
a heat room that houses a food material to be cooked and is supplied with superheated steam from the outlet;
a circulation fan that circulates steam in the heat room; and a circulation heater that heats the steam circulated by the circulation fan.

14. A cooking device comprising:

the steam generating device according to claim 4;

a heat room that houses a food material to be cooked and is supplied with superheated steam from the outlet;

a circulation fan that circulates steam in the heat room; and a circulation heater that heats the steam circulated by the circulation fan.

15. A cooking device comprising:

the steam generating device according to claim 5;

a heat room that houses a food material to be cooked and is supplied with superheated steam from the outlet;

a circulation fan that circulates steam in the heat room; and a circulation heater that heats the steam circulated by the circulation fan.

16. A cooking device comprising:

the steam generating device according to claim 6;

a heat room that houses a food material to be cooked and is supplied with superheated steam from the outlet;

a circulation fan that circulates steam in the heat room; and a circulation heater that heats the steam circulated by the circulation fan.

17. A cooking device comprising:

the steam generating device according to claim 7;

a heat room that houses a food material to be cooked and is supplied with superheated steam from the outlet;

a circulation fan that circulates steam in the heat room; and a circulation heater that heats the steam circulated by the circulation fan.

18. A cooking device comprising:

the steam generating device according to claim 8;

a heat room that houses a food material to be cooked and is supplied with superheated steam from the outlet;

a circulation fan that circulates steam in the heat room; and a circulation heater that heats the steam circulated by the circulation fan.

19. A cooking device comprising:

the steam generating device according to claim 9;

a heat room that houses a food material to be cooked and is supplied with superheated steam from the outlet;

a circulation fan that circulates steam in the heat room; and a circulation heater that heats the steam circulated by the circulation fan.

20. A cooking device comprising:

the steam generating device according to claim 10;

a heat room that houses a food material to be cooked and is supplied with superheated steam from the outlet;

a circulation fan that circulates steam in the heat room; and a circulation heater that heats the steam circulated by the circulation fan.

* * * * *